US007140898B2

(12) United States Patent
Sanuki et al.

(10) Patent No.: US 7,140,898 B2
(45) Date of Patent: Nov. 28, 2006

(54) ELECTRICAL CONNECTOR

(75) Inventors: Hidenori Sanuki, Shizuoka (JP); Takanori Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/408,992

(22) Filed: Apr. 24, 2006

(65) Prior Publication Data

US 2006/0240698 A1 Oct. 26, 2006

(30) Foreign Application Priority Data

Apr. 25, 2005 (JP) ..... 2005-126881

(51) Int. Cl.
*H01R 4/54* (2006.01)

(52) U.S. Cl. ..... 439/314; 439/352; 439/321

(58) Field of Classification Search ..... 439/321, 439/314, 544, 562, 564, 565, 573, 575, 35
See application file for complete search history.

(56) References Cited

U.S. PATENT DOCUMENTS

| | | | | |
|---|---|---|---|---|
| 4,822,302 | A * | 4/1989 | Dorleans | 439/544 |
| 5,980,293 | A | 11/1999 | Nagano | |
| 6,226,068 | B1 * | 5/2001 | Arcykiewicz et al. | 439/314 |
| 6,234,819 | B1 * | 5/2001 | Oka | 439/321 |
| 6,685,493 | B1 * | 2/2004 | Birkenmaier et al. | 439/314 |
| 7,077,677 | B1 * | 7/2006 | Sanuki | 439/318 |
| 2005/0208820 | A1 * | 9/2005 | Sanuki | 439/372 |

FOREIGN PATENT DOCUMENTS

| | | |
|---|---|---|
| JP | 4-132178 | 5/1992 |
| JP | 2001-6814 | 1/2001 |
| JP | 2005-267930 | 9/2005 |

* cited by examiner

*Primary Examiner*—James Harvey
*Assistant Examiner*—Travis Chambers
(74) *Attorney, Agent, or Firm*—Armstrong, Kratz, Quintos, Hanson & Brooks, LLP

(57) ABSTRACT

The electrical connector has a main housing and a turnable member turnably supported on the main housing. The turnable member is turned to move a second connector toward the main housing from an initial mating state of the main housing with the second connector so as to completely couple the main housing with the second connector. The connector has a resilient engagement arm extended from the turnable member, a stopper projection formed in the resilient engagement arm, a guide portion formed in the main housing, and an engagement recess formed in the main housing. The stopper projection abuts against the guide portion so that the resilient engagement arm is in a yielded condition at a half-way mating state of the main housing with the second connector, while the stopper projection locks with the engagement recess by resiliency of the engagement arm when the main housing has completely coupled with the second connector. The connector has a locking arm formed in the turnable member and having an operating portion. The locking arm has resiliency to be positioned so as to bring the engagement arm in a locked state where the engagement arm is in a released condition, while the locking arm is deflected by the operating portion so as to bring the engagement arm in an unlocked state where the engagement arm can be in the yielded condition.

2 Claims, 7 Drawing Sheets

ELECTRICAL CONNECTOR

BACKGROUND OF THE INVENTION

1. Field of the Invention

The present invention relates to an electrical connector such a waterproof one used for a motor vehicle, more particularly to a low coupling-force connector. The connector is reduced in size and cost with a sufficient reliability.

2. Related Art

A waterproof connector used for a motor vehicle generally requires a larger mating force than a non-waterproof one. Because, the waterproof connector must have a watertight structure with a packing made of rubber or the like. Recently, such connectors have a lot of terminals, which requires a further larger mating force. This disadvantageously causes incomplete mating of connecters, incorrect electrical connection, or insufficient watertightness.

To improve the situation, a pair of connectors called as a bayonet or spigot type are provided. The pair of connectors are provisionally engaged with each other, and then a turnable member provided on one of the connectors is turned to move the connectors toward each other for completion of the engagement. This requires a comparatively smaller engagement force since the connectors turns when mated in waterproof connectors having multi-terminals that otherwise would need a larger engagement force.

FIG. 9 shows a pair of male and female connectors 40, 41 disclosed in Japanese Patent Application Laid-open No. H-4-132178. The connectors 40, 41 accommodate terminals 42 or 43. The male connector 40 has a turnable locking hood 44 (turnable member) having an inner wall formed with a protrusion 45. The female connector 41 has an outer surface formed with a helical groove 46. The protrusion 45 enters an open end of the helical groove 46.

The locking hood 44 turns from an initial provisional engagement state of the connectors 40, 41, so that the protrusion 45 engages the helical groove 46 to provide a cam action to move the female connector 41 until the protrusion 45 reaches an end of the helical groove 46 to complete engagement of the connectors 40, 41 for electrical connection thereof.

The turning force of the locking hood 44 provides a larger mating force by the helical groove 46, advantageously enabling an easy mating operation of the connectors 40, 41.

In this case, an operator generally knows the engagement completion of the connectors by recognition of a change in turning torque of the turnable member. However, there is a possibility of incomplete engagement of the connectors, because the recognition of the engagement depends on feeling of the operator.

This is, the operator may possibly stop the turning of the turnable member before the projection reaches the end of the helical groove, causing incomplete engagement of the connectors not to keep waterproofness of the connectors against external water.

Furthermore, when the connectors are mounted in a motor vehicle, even after the complete engagement of the connectors, an external force or vibration may possibly cause loosening of the turning member to make the engagement incomplete, bringing about incorrect electrical connection or disengagement of the connectors.

To solve the problem, an electrical connector proposed in U.S. Pat. No. 5,980,293, as shown in FIG. 10, has a pair of male and female connectors 50. The male connector has a turnable member 51 that engages with the female connector. After initial provisional mating of the male and female connectors 50, the turnable member 51 turns to move the male connector to completely engage the connectors with each other for electrical connection thereof. Furthermore, an additional engagement recognition piece 52 is provided to confirm the complete engagement of the male and female connectors. When the turning of the turnable member 51 completely engages the male and female connectors with each other, a protrusion 54 defined in the engagement recognition piece 52 is locked in a concave 55 formed in the turnable member 51. Meanwhile, when the turning of the turnable member 51 incompletely engages the male and female connectors with each other, the protrusion 54 is not locked in the concave 55. Thus, an operator recognizes whether the connectors have engaged completely with each other by the engagement state of the protrusion 54 of the engagement recognition piece 52 with the concave 55 of the turnable member 51.

Japanese Patent Application Laid-open No. 2001-6814 proposes a pair of connectors that are pushed axially against each other when mated. The connectors have an engagement ring that is turned when the connectors are disengaged. Moreover, a locking mechanism is provided for the connectors.

As shown in FIG. 11, the connectors have a cylindrical plug 60, a counter plug 61, and a bayonet ring 62. The counter plug 61 has a housing 63 around which the bayonet ring 62 is turnably attached. The bayonet ring 62 locks the plug 60 to the counter plug 61. The plug 60 is pushed against the housing 63 of the counter plug 61 until a locking mechanism provided in the bayonet ring 62 locks to the housing 64 of the plug 60. The plug 60 has a strap 65 for locking the turning of the bayonet ring 62 at the complete engagement state of the connectors. When the connectors 60, 61 are disengaged from each other, the bayonet ring 62 is turned around the housing 63 of the counter plug 61 to release the locking.

However, these conventional arts require additional parts or operational works to confirm complete engagement of a pair of connectors, increasing a production cost and decreasing an operational efficiency thereof.

SUMMARY OF THE INVENTION

Therefore, to improve the situation, an object of the present invention is to provide connectors that require a smaller mating force without additional parts. The connecters are easy in their engagement operation and in recognition of the complete engagement of the connectors.

To achieve the above-mentioned object, an electrical connector according to the present invention includes:

a main housing, a turnable member turnably supported on the main housing, the turnable member turned to move a second connector toward the main housing from an initial mating state of the main housing with the second connector so as to completely couple the main housing with the second connector, a resilient engagement arm extended from the turnable member, a stopper projection formed in the resilient engagement arm, a guide portion formed in the main housing, and an engagement recess formed in the main housing. The stopper projection abuts against the guide portion so that the resilient engagement arm is in a yielded condition at a half-way mating state of the main housing with the second connector, while the stopper projection locks with the engagement recess by resiliency of the engagement arm when the main housing has completely coupled with the second connector. The connector further has a locking arm formed in the turnable member and having an operating portion for deflecting the locking arm. The locking arm has resiliency to be positioned so as to bring the engagement arm in a locked state where the engagement arm is in a released condition, while the locking arm is resiliently deflected so as to bring the engagement arm in an unlocked state where the engagement arm is in the yielded condition.

Thus, the connectors require a smaller mating force without additional parts. The connecters are easy in their engagement operation and in recognition of the complete engagement of the connectors. An operator can recognize the engagement completion only by viewing the state of operating portion of the locking arm.

Preferably, the main housing has a protector surrounding the locking arm operating portion.

This surely keeps the complete engagement of the connectors against an external force and prevents unintentional release of the locking of the locking arm.

DETAILED DESCRIPTION OF PREFERRED EMBODIMENT

Figure 1A:
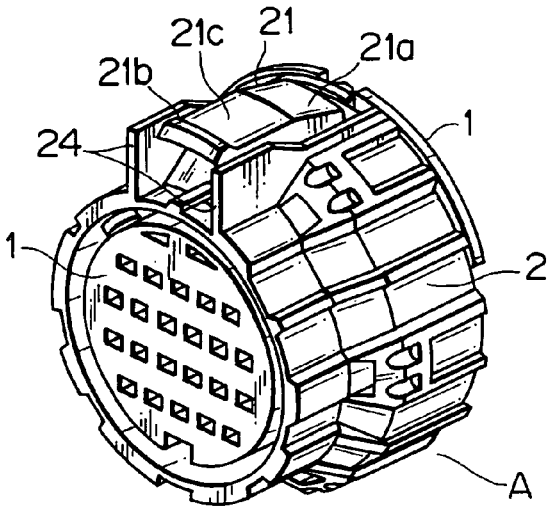
FIGS. 1A, 1B show an electrical connector according to the present invention, FIG. 1A showing a perspective view taken from an opposing connector side, and FIG. 1B a perspective view taken from a terminal insertion side.

Referring to FIGS. 1 to 8, an embodiment of the present invention will be discussed.

In the drawings, reference numeral 1 designates a connector main body (front holder), and reference numeral 2 designates a turnable member turnably supported by the main housing 1. The body and housing is basically made of insulating materials.

Figure 1B:
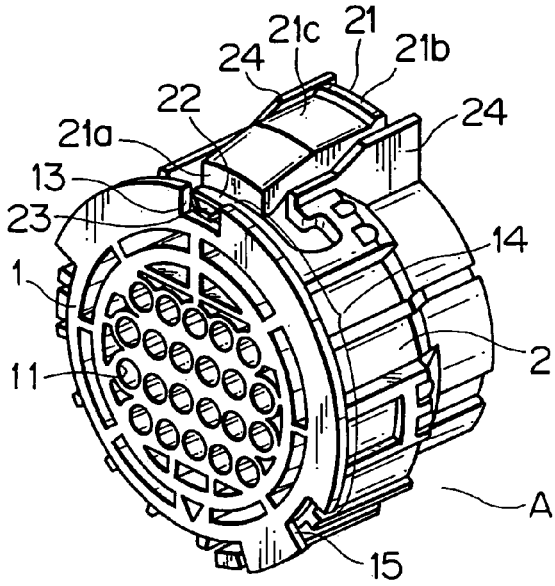
Figure 3:
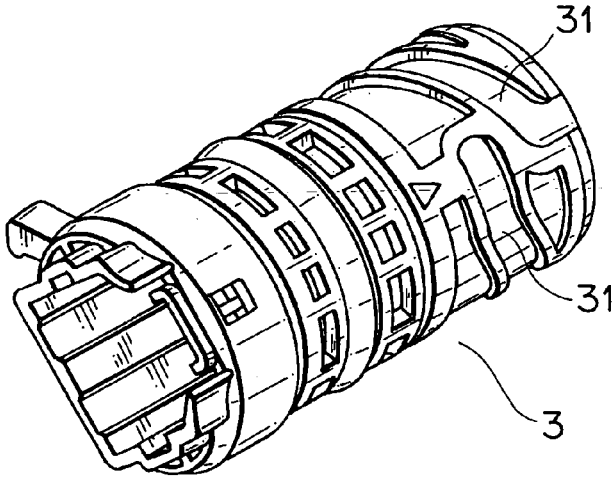
FIG. 3 is a perspective view showing the opposing connector mating with the connector according to the present invention.
Figure 2:
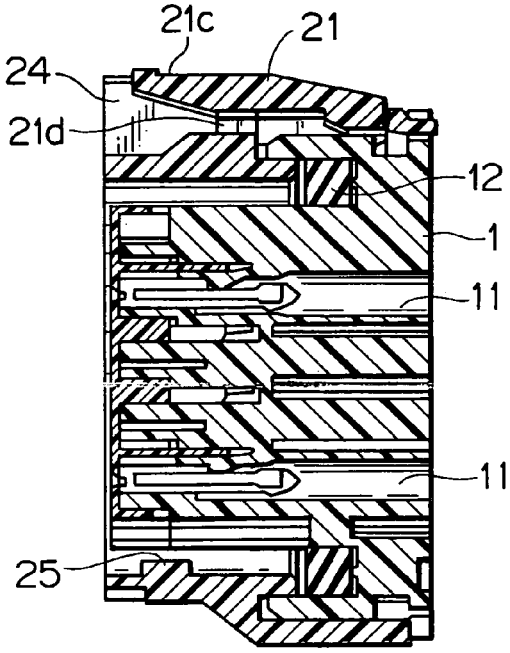
FIG. 2 is a sectional view including a locking arm.

The turnable member 2 has a locking arm 21. In FIGS. 1A, 1B, and 2, the turnable member 2 of a connector A is positioned in a state to be ready for initial engagement with an opposing connector 3.

The main housing 1 has a plurality of terminal accommodation chambers 11 for accommodating connector terminals (not shown). The terminal accommodation chambers 11 can receive associated terminals (not shown) of the opposing connector 3.

The connector A has a packing 12 to keep watertightness inside the connector at the complete engagement with the opposing connector 3.

The turnable member 2 has a generally cylindrical body provided with a flexible and resilient engagement arm 22 positioned in a terminal insertion side of the connector. The engagement arm 22 is extended along a circumferential direction of the turnable member 2. The engagement arm 22 is formed unitarily with the turnable member 2 not to increase the number of constitutional parts of the connector.

Furthermore, the engagement arm 22 is formed with a stopper projection 23 protruding forward from its fore end in an axial direction of the turnable member 2. The stopper projection 23 has a base side surface extended in an axial direction of the turnable member 2 and another surface inclined to the axial direction so as to come close to the base side surface.

The main housing 1 has a guide portion 14 defining a radially extended flange. The guide portion 14 is positioned parallel to an annular end face of the turnable member 2 when the turnable member 2 is turnably supported by the main housing 1. The guide portion 14 has a projection receiving recess 13 at one end and a locking recess 15 at an opposed end. As shown in FIG. 1B, the stopper projection 23 of the engagement arm 22 is positioned at the projection receiving recess 13 when the turnable member 2 is in an initial provisional engagement state, so that the stopper projection 23 does not abut against the guide portion 14. Therefore, the engagement arm 22 is freely extended or not restricted. This advantageously prevents a plastic deformation of the engagement arm 22 even when the turnable member 2 is kept in the initial provisional engagement state for a long time.

Furthermore, the turnable member 2 has a locking arm 21 pivotally formed on an outer surface thereof via a connection piece 21*d*. Preferably, the locking arm is unitarily formed with the turnable member 2 to decrease the number of parts, reducing a manufacturing cost. The locking arm 21 can pivot by pushing an operating portion 21*c* by a finger because of resilient deformation of the connection piece 21*d*. The locking arm is normally in its locking state where the engagement arm 22 is locked. Meanwhile, The locking arm 21 can pivot by pushing the operating portion 21*c* to its unlocking state where the engagement arm 22 is released. In the locked condition, a forward end 21*a* of the locking arm 21 is abutting against a side surface of the main housing 1, while, in the released condition, an opposed end 21*b* of the locking arm 21 is biased toward the main housing 1. The locking arm 21 is resiliently pivoted to unlock the engagement arm.

Alternatively, the locking arm 21 may be provided as a separate body and may be biased by an urging device like a spring (not shown) such that the biased locking arm achieves its normal locking state and is released by pushing the operating portion 21*c*.

In mating of the connectors, first, an operator moves an operating portion 21*c* of the locking arm 21. The locking arm 21 is pivoted such that the rear end 21*b* of the locking arm 21 is moved toward the turnable member 2, where the engagement arm 22 can be deflectable.

Meanwhile, the locking arm 21 can lock the engagement arm 22 only when the engagement arm 22 is in the released or not-deflected state. The engagement arm 22 can not be deflected where the locking arm 21 has locked the engagement arm 22.

Furthermore, around the operating portion 21*c*, there is provided a protector 24 having a sufficient height for protecting the operating portion 21*c* that is in the locked state against an unintentional external force exerted thereon to surely keep the complete engagement of the connectors.

Figure 4:
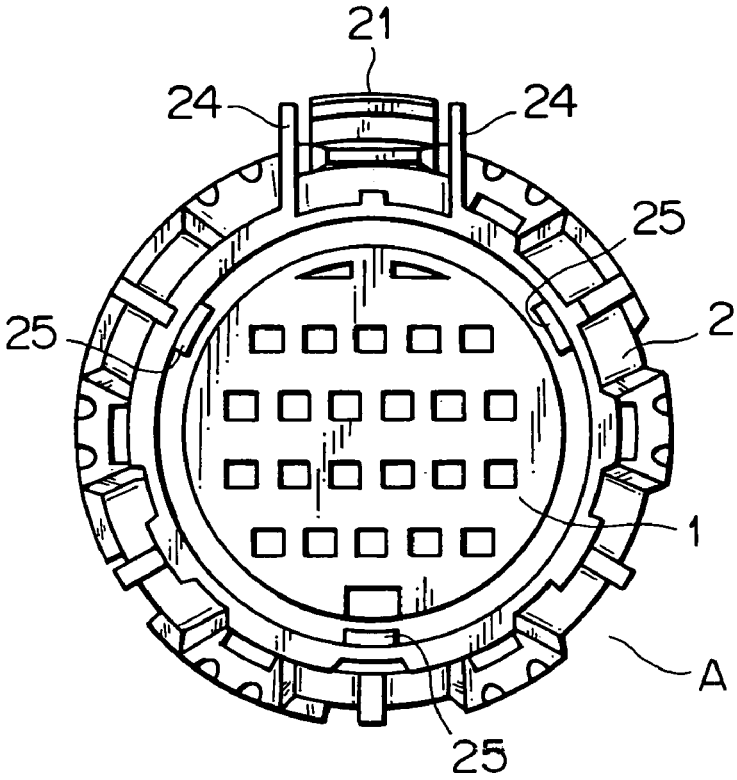
FIG. 4 is a front view of the connector, which faces to the opposing connector.
Figure 5:
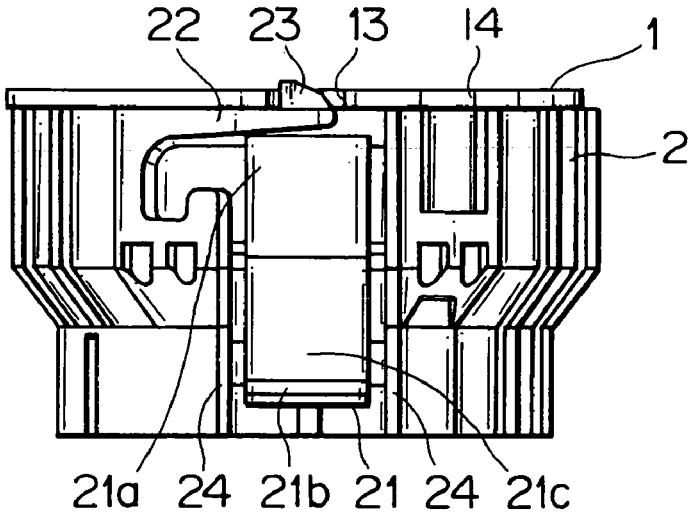
FIG. 5 is a side view of the connector, which includes the locking arm.

The turnable member 2 has an inner surface formed with a protrusion 25 providing a cam mechanism with a cam guide channel 31 formed in a side surface of the opposing connector 3 as shown in FIGS. 2 and 4. At the initial mating of the connectors, the turning of the turnable member 2 operates the cam mechanism to move the opposing connector 3 to complete the engagement of the connectors.

Thus, the electrical connector A according to the present invention has the main housing 1 and the turnable member 2 turnably supported on the main housing. The turnable member 2 turns to move the opposing connector 3 toward the main housing 1 from an initial mating state of the main housing 1 with the opposing connector so as to completely couple the main housing 1 with the second connector. The connector A has the resilient engagement arm 22 extended from the turnable member 2, the stopper projection 23 formed in the resilient engagement arm 22, the guide portion 14 formed in the main housing 1, and the locking recess 15 formed in the main housing 1. The stopper projection 23 abuts against the guide portion 14 so that the resilient engagement arm 22 is in a yielded condition at a half-way mating state of the main housing 1 with the second connector 3, while the stopper projection 23 locks with the locking recess 15 by resiliency of the engagement arm 22 when the main housing 1 has completely coupled with the second connector 3. Furthermore, the connector A has the locking arm 21 formed in the turnable member 2 and having the operating portion 21*c*. The locking arm 21 has resiliency to be positioned so as to bring the engagement arm 22 in a locked state where the engagement arm 22 is in the released condition, while the locking arm 21 is resiliently deflected so as to bring the engagement arm 22 in an unlocked state where the engagement arm 22 is in the yielded condition.

Referring to FIGS. 6 to 8, the engagement steps of the connector A with the opposing connector 3 will be discussed in operation thereof.

Figure 6A:
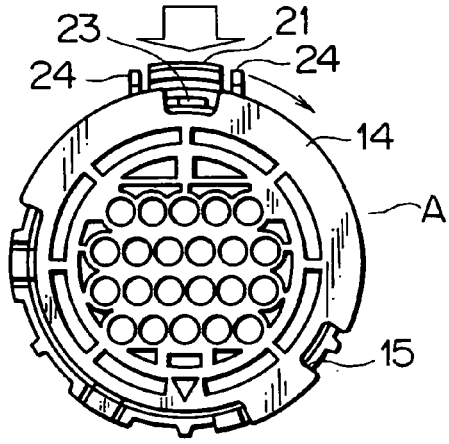
FIGS. 6A, 6B, 6C show views to explain states before engagement of the connectors in respect of a turnable member, a engagement arm, and the locking arm, FIG. 6A particularly showing the turnable member, FIG. 6B the engagement arm, and FIG. 6C the locking arm.
Figure 6B:
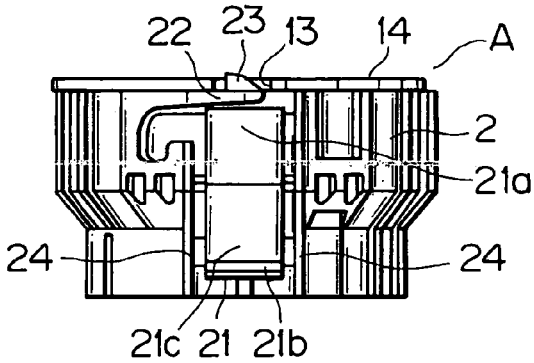
Figure 6C:
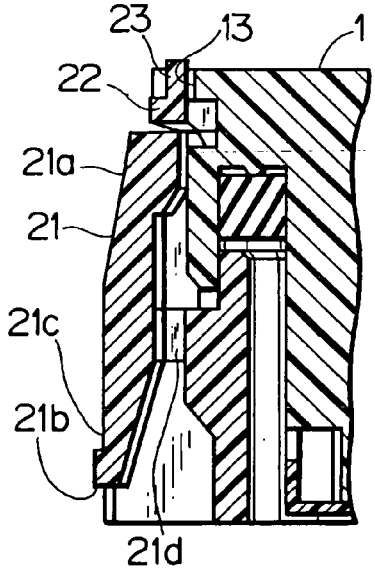

As shown in FIGS. 6A, 6B, and 6C, at the initial mating step, the stopper projection 23 of the engagement arm 22 is positioned in the projection receiving recess 13 of the main housing 1 so that the engagement arm 22 is in the released state.

Since the locking arm 21 has resiliency to bias the locking arm 21 toward the locking position, the forward end 21*a* of the locking arm 21 abuts against the side surface of the main housing 1. Thus, there is no space to allow the deflection of the engagement arm 22 to prohibit the deflection of the engagement arm 22. That is, the turnable member 2 keeps the initial engagement state to prevent the turnable member 2 from unintentional turning.

Figure 7A:
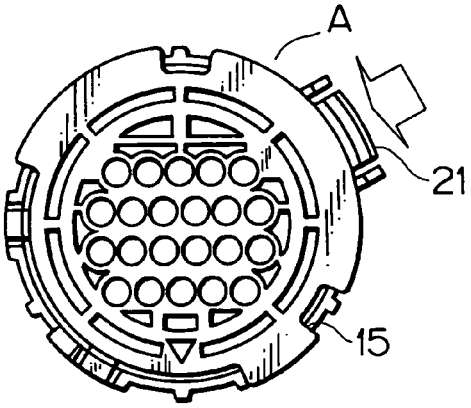
FIGS. 7A, 7B, 7C show views to explain a half-way state during engagement of the connectors in respect of the turnable member, engagement arm, and locking arm, FIG. 7A particularly showing the turnable member, FIG. 7B the engagement arm, and FIG. 7C the locking arm.
Figure 7B:
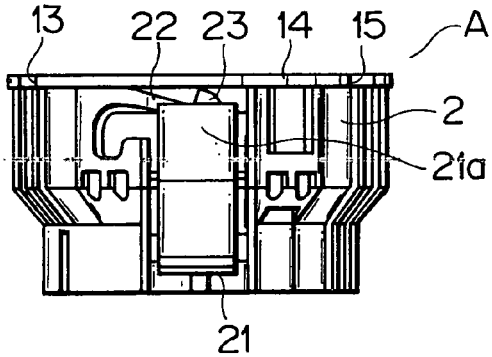
Figure 7C:
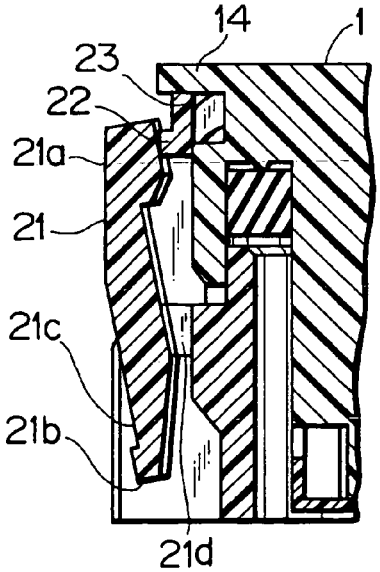

Next, a half-way engagement state of the connectors will be discussed. As shown in FIGS. 7A, 7B, and 7C, after the initial mating step, the operator moves the operating portion 21*c* of the locking arm 21 to move the rear end 21*b* of the locking arm 21 close to a side surface of the main housing 1 so that the forward end 21*a* comes apart from the main housing 1 (unlocked state). Then, the turnable member 2 is turned in an arrow direction shown in FIG. 6A with the engagement arm 22 being deflected. The stopper projection 23 transfers from the projection receiving recess 13 to the guide portion 14 with the turning of the turnable member 2 while the stopper projection 23 is contacting the guide portion 14 so that the engagement arm 22 keeps its deflected state.

As shown in FIG. 7C, the locking arm 21 can not return to the locked state since the engagement arm 22 is in the deflected condition. This keeps the unlocked state of the locking arm 21 without any operation of the operating portion 21*c*.

Further tuning of the turnable member 2 the stopper projection 23 of the engagement arm 22 moves along the guide portion 14 toward the locking recess 15.

Figure 8A:
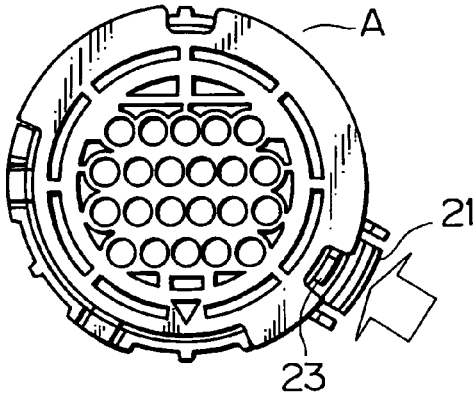
FIGS. 8A, 8B, 8C show views to explain a state after the engagement of the connectors in respect of the turnable member, engagement arm, and locking arm, FIG. 8A particularly showing the turnable member, FIG. 8B the engagement arm, and FIG. 8C the locking arm.
Figure 8B:
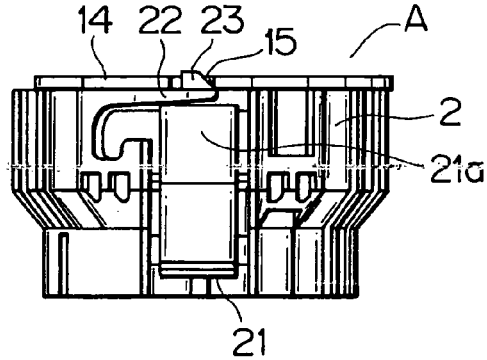
Figure 8C:
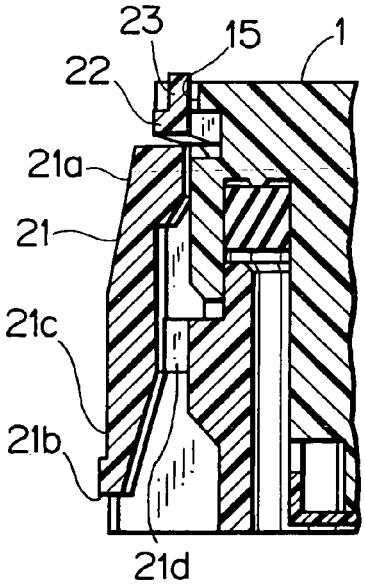
Figure 9:
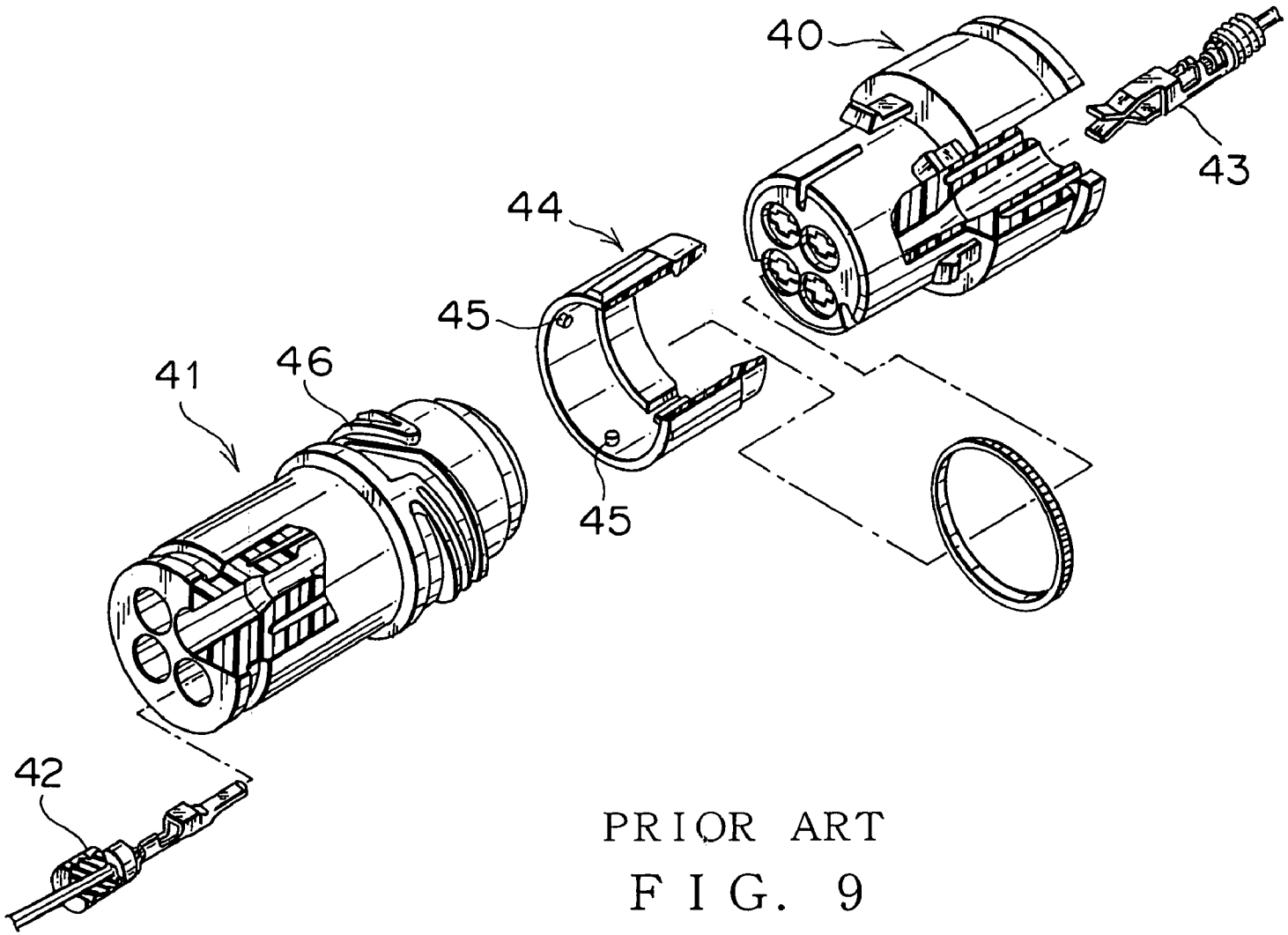
PRIOR ART FIG. 9
FIG. 9 is a perspective view showing a pair of prior-art connectors.
Figure 10:
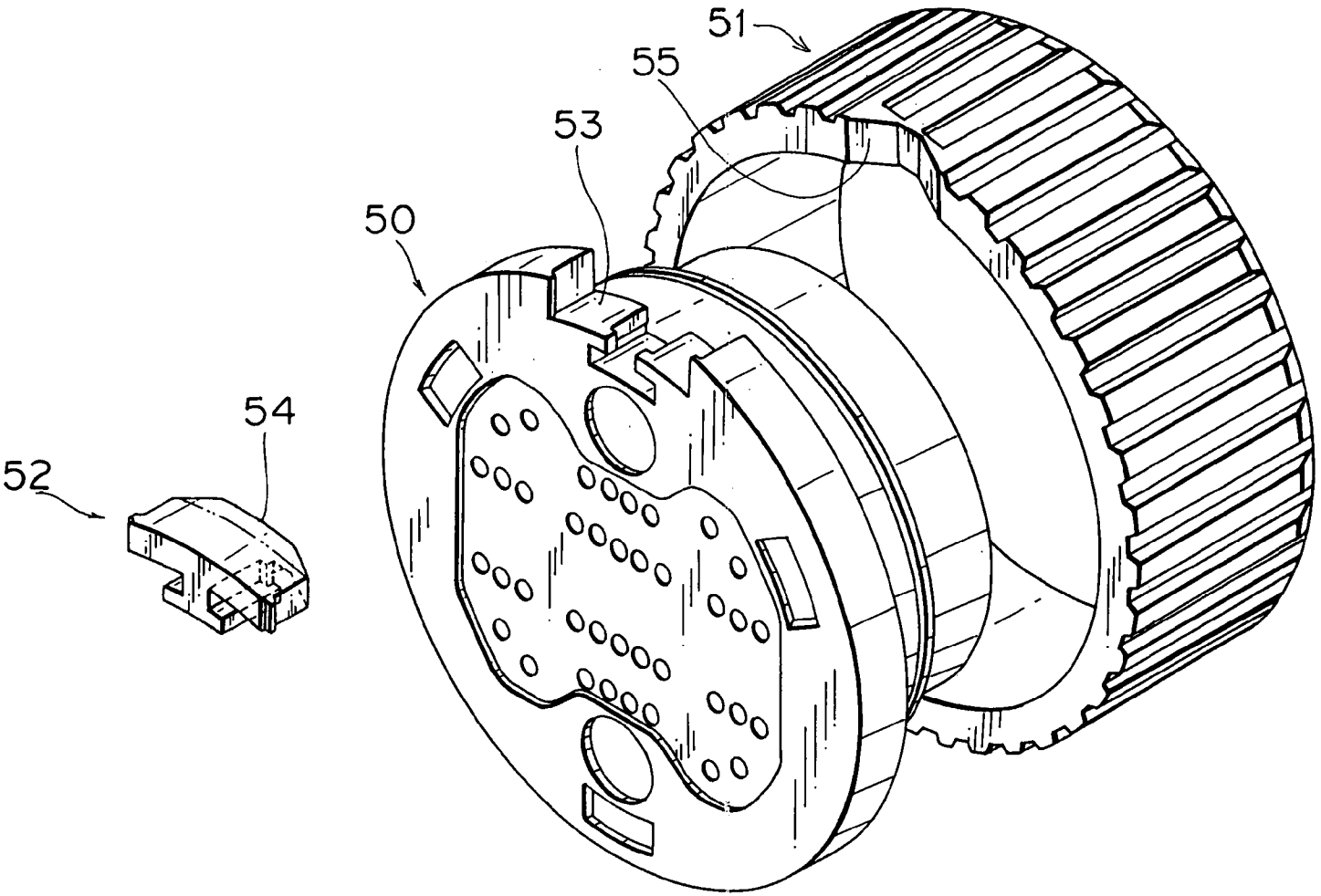
PRIOR ART FIG. 10
FIG. 10 is a perspective view showing another prior-art connector.
Figure 11B:
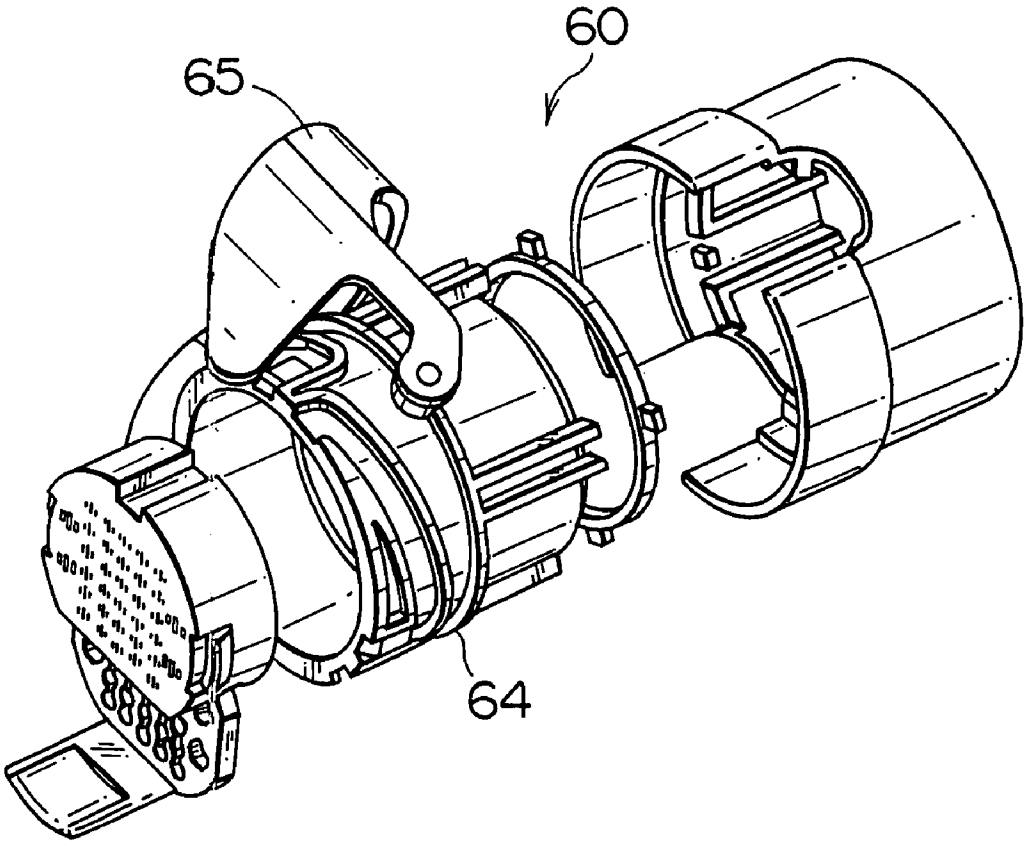
PRIOR ART FIG. 11B
FIGS. 11A, 11B are perspective views showing a further another pair of prior-art connectors.
Figure 11A:
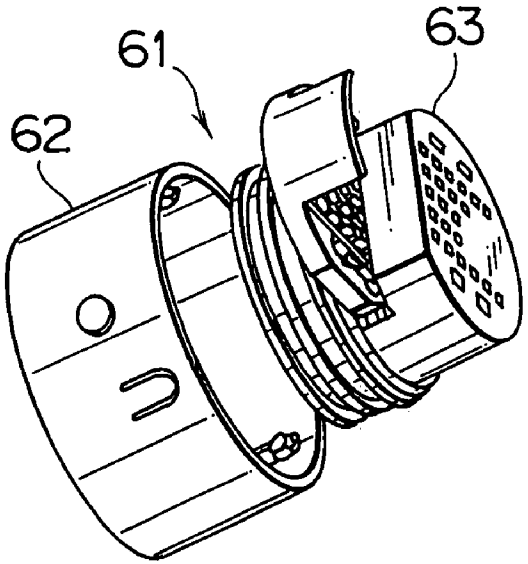
PRIOR ART FIG. 11A

As shown in FIGS. 8A, 8B, and 8C, when the turnable member 2 has moved in the complete mating state, the resiliency of the engagement arm 22 engages the stopper projection 23 with the locking recess 15. The engagement arm 22 is released from the deflected state to return to the released state while the engagement arm 22 is brought in the locked condition by the resiliency of the engagement arm 22.

At the complete mating of the connectors, the locking recess 15 keeps its locking state since the stopper projection 23 has the locking surface perpendicular to an axial direction of the connector A. Furthermore, the deflection of the engagement arm 22 is prohibited since the engagement arm 22 is in the locked state. Thus, the turnable member 2 is surely prevented from returning to the initial mating state. The operator can confirm the complete mating of the connectors by recognizing the locked state of the engagement arm 22, allowing reliable recognition of the complete mating with ease. At the complete mating state of the connectors, the engagement arm 22 is released from the deflected state to be in the released state. Thus, the engagement arm 22 is prevented from its plastic deformation to function correctly even when the connector A is used for a long time at the complete mating state.

Accordingly, the present invention provides connectors that require a smaller mating force without additional parts. The connectors are easy in their engagement operation and in recognition of the complete engagement of the connectors only by recognizing the locking state of the locking arm.

What is claimed is:

1. An electrical connector comprising:

a main housing (1), a turnable member (2) turnably supported on the main housing, the turnable member turned to move a second connector toward the main housing from an initial mating state of the main housing with the second connector so as to completely couple the main housing with the second connector, a resilient engagement arm (22) extended from the turnable member, a stopper projection (23) formed in the resilient engagement arm, a guide portion (14) formed in the main housing, an engagement recess (15) formed in the main housing, the stopper projection abutting against the guide portion with the turnable member being turned from the initial mating state so that the resilient engagement arm is in a yielded condition, while the stopper projection is locked in the engagement recess by resiliency of the engagement arm when the main housing has completely coupled with the second connector, and a locking arm (21) formed in the turnable member and having an operating portion (21*c*) for deflecting the locking arm, wherein the locking arm has resiliency to be positioned so as to bring the engagement arm in a locked state where the engagement arm is in a released condition, while the locking arm is deflected by the operating portion so as to bring the engagement arm in an unlocked state where the engagement arm can be in the yielded condition.

2. The electrical connector recited in claim 1 wherein the main housing (1) has a protector (24) surrounding the locking arm operating portion (21*c*).

* * * * *